US011052692B2

(12) United States Patent
Shih

(10) Patent No.: US 11,052,692 B2
(45) Date of Patent: Jul. 6, 2021

(54) COVERING ASSEMBLY FOR A STAMP

(71) Applicant: Sun Same Enterprises Co., Ltd., Tainan (TW)

(72) Inventor: Wen-Jer Shih, Tainan (TW)

(73) Assignee: Sun Same Enterprises Co., Ltd., Tainan (TW)

( * ) Notice: Subject to any disclaimer, the term of this patent is extended or adjusted under 35 U.S.C. 154(b) by 236 days.

(21) Appl. No.: 16/118,564

(22) Filed: Aug. 31, 2018

(65) Prior Publication Data

US 2020/0039267 A1 Feb. 6, 2020

(30) Foreign Application Priority Data

Aug. 2, 2018 (TW) ..... 107126872

(51) Int. Cl.

| | |
|---|---|
| ***B41K 1/36*** | (2006.01) |
| *B41K 1/00* | (2006.01) |
| *B41K 1/38* | (2006.01) |
| *B41K 1/56* | (2006.01) |

(52) U.S. Cl.

CPC ..... *B41K 1/36* (2013.01); *B41K 1/00* (2013.01); *B41K 1/38* (2013.01); *B41K 1/56* (2013.01)

(58) Field of Classification Search

CPC ... B41K 1/02; B41K 1/36; B41K 1/38; B41K 1/40; B41K 1/50; B41K 1/54; B41K 1/56; B41K 1/00

See application file for complete search history.

(56) References Cited

U.S. PATENT DOCUMENTS

| | | | | |
|---|---|---|---|---|
| 6,189,450 | B1 * | 2/2001 | Shih | B41K 1/52 101/125 |
| 7,066,089 | B1 * | 6/2006 | Shih | B41K 1/40 101/327 |
| 9,630,435 | B1 * | 4/2017 | Shih | B41K 1/56 |
| 10,513,134 | B1 * | 12/2019 | Chen | B41K 1/02 |
| 2006/0065142 | A1 * | 3/2006 | Petersen | B41K 1/54 101/333 |
| 2013/0025484 | A1 * | 1/2013 | Faber | B41K 1/40 101/333 |

FOREIGN PATENT DOCUMENTS

| | | | | |
|---|---|---|---|---|
| EP | 0655343 | * 5/1995 | | B41K 1/32 |
| EP | 2783877 | * 10/2014 | | B41K 1/38 |
| JP | 2003034065 | * 2/2003 | | B41K 1/36 |
| JP | 2003-305932 | * 10/2003 | | B41K 1/36 |

(Continued)

*Primary Examiner* — Matthew G Marini
*Assistant Examiner* — Marissa Ferguson-Samreth
(74) *Attorney, Agent, or Firm* — Alan D. Kamrath; Karin L. Williams; Mayer & Williams PC

(57) ABSTRACT

A covering assembly is disposed on an inked printing assembly of a stamp. The covering assembly has a top cover and a bottom cover. The top cover is detachably disposed above the inked printing assembly. The bottom cover is detachably disposed below the inked printing assembly, is located below the top cover at a spaced interval, and has a bottom wall. The covering assembly can assist in assembling the inked printing assembly. The disposition of the top cover and the bottom cover can transfer pointed force into planar force for increasing a contact area, the forcing uniformity, and the assembly convenience.

6 Claims, 10 Drawing Sheets

(56) References Cited

FOREIGN PATENT DOCUMENTS

| | | | | | |
|---|---|---|---|---|---|
| JP | 2004-017578 | * | 1/2004 | ..... | B41K 1/50 |
| JP | 2004-060685 | * | 7/2004 | ..... | B41K 1/40 |
| JP | 2004-243645 | * | 9/2004 | ..... | B41K 1/50 |
| WO | 9722478 | * | 6/1997 | ..... | B41K 1/40 |
| WO | 2005-037565 | * | 4/2005 | ..... | B41K 1/40 |

* cited by examiner

COVERING ASSEMBLY FOR A STAMP

This application claims the benefit of Taiwan patent application No. 107126872, filed on Aug. 2, 2018, the entire contents of which are incorporated herein by reference.

BACKGROUND OF THE INVENTION

1. Field of the Invention

The present invention relates to a covering assembly for a stamp, and more particularly to a covering assembly that is convenient to assemble the stamp.

2. Description of Related Art

A conventional stamp has an inked printing assembly, a handle, a restoring member, and a protecting cover. The handle is mounted on the inked printing assembly. The restoring member is disposed between the inked printing assembly and the handle. Two ends of the restoring member respectively abut against the inked printing assembly and the handle. The protecting cover is disposed on a bottom of the inked printing assembly. The inked printing assembly has a fixing seat and a moving seat. The moving seat is moveably disposed in the fixing seat and has an inked member and a printing member. The inked member is moveably disposed in the fixing seat. The printing member engages with a bottom of the inked member and has a bottom frame, a block, an ink pad, and a top frame. An opening is formed on a bottom surface of the bottom frame. The block is disposed on the bottom frame and has a printing surface protruded out of the opening of the bottom frame. The ink pad is disposed on the block. The top frame engages with the bottom frame and the bottom of the inked member.

In delivery, the inked member is disposed in the fixing seat. A top end of the inked member protrudes out of the fixing seat. The top frame of the printing member engages with the inked member. The ink pad is disposed on the top frame. After the block is exposed and etched, the block is disposed on the bottom frame. The bottom frame is inserted into the fixing seat and is located below the inked member. Two hands of a user are respectively located at two sides of the inked printing assembly and grab the top end of the inked member and a bottom edge of the bottom frame. An upward pushing force and a downward pushing force are applied by each of the two hands. The upward pushing forces applied by the two hands are respectively forced on two sides of the bottom edge of the bottom frame, and the downward pushing forces applied by the two hands are respectively forced on two sides of the top end of the inked member for assembling the bottom frame on the top frame.

However, the two hands of the user are directly forced on the two sides of the bottom edge of the bottom frame. A contact area between the two hands and the top end of the inked member is small, and thereby the upward pushing force cannot be equally exerted on the bottom edge of the bottom frame and the downward pushing force cannot be equally exerted on the top end of the inked member. The bottom frame or the inked member is easy to skew by the unequal forces. The position of the bottom frame or the position of the inked member needs readjustment. The upward pushing force and the downward pushing force need readjustment also. The moving seat is manually assembled and the assembly thereof is inconvenient.

To overcome the shortcomings, the present invention provides a covering assembly for a stamp to mitigate or obviate the aforementioned problems.

SUMMARY OF THE INVENTION

The objective of the invention is to provide a covering assembly for a stamp that can solve the shortcoming that the conventional moving seat is manually assembled and the assembly of the moving seat is inconvenient.

The covering assembly is disposed on an inked printing assembly of the stamp. The covering assembly has a top cover and a bottom cover. The top cover is detachably disposed above the inked printing assembly. The top cover has a covering plate and a top wall. The covering plate has an outer edge. The top wall is formed on and downwardly protrudes out of the outer edge of the covering plate. The bottom cover is detachably disposed below the inked printing assembly, is located below the top cover at a spaced interval, and has a supporting plate, a bottom wall, and a chamber. The supporting plate has an outer edge. The bottom wall is formed on and upwardly protrudes out of the outer edge of the supporting plate. The chamber is formed in the bottom cover and is enclosed by the bottom wall.

To assemble the inked printing assembly, an inked member is moveably disposed in the fixing seat. The top cover is disposed on a top end of the inked member. A top frame of a printing member engages with the inked member. An ink pad of the printing member is disposed on the top frame. A block of the printing member is disposed on a bottom frame of the printing member and is inserted into the fixing seat. The bottom cover is inserted into the fixing seat. A top edge of the bottom wall of the bottom cover abuts against an outer edge of a bottom surface of the bottom frame. Two hands of a user directly grab the top cover and the bottom cover. The top cover and the bottom cover are forced by the two hands of the user for assembling the bottom frame on the top frame. After the assembly of the inked printing assembly is finished, the top cover and the bottom cover can be detached from the inked printing assembly. The disposition of the top cover and the bottom cover can transfer the pointed force into the planar force for increasing a contact area, the forcing uniformity, and the assembly convenience.

For delivery, the inked member is disposed in the fixing seat. The top cover is disposed on the top end of the inked member. The top frame of the printing member engages with the inked member. The ink pad is disposed on the top frame. The bottom cover is inserted into the fixing seat and is located below the ink pad. A protecting cover of the stamp covers the fixing seat and is located below the bottom cover. The covering assembly can protect ink in the ink pad from evaporating.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
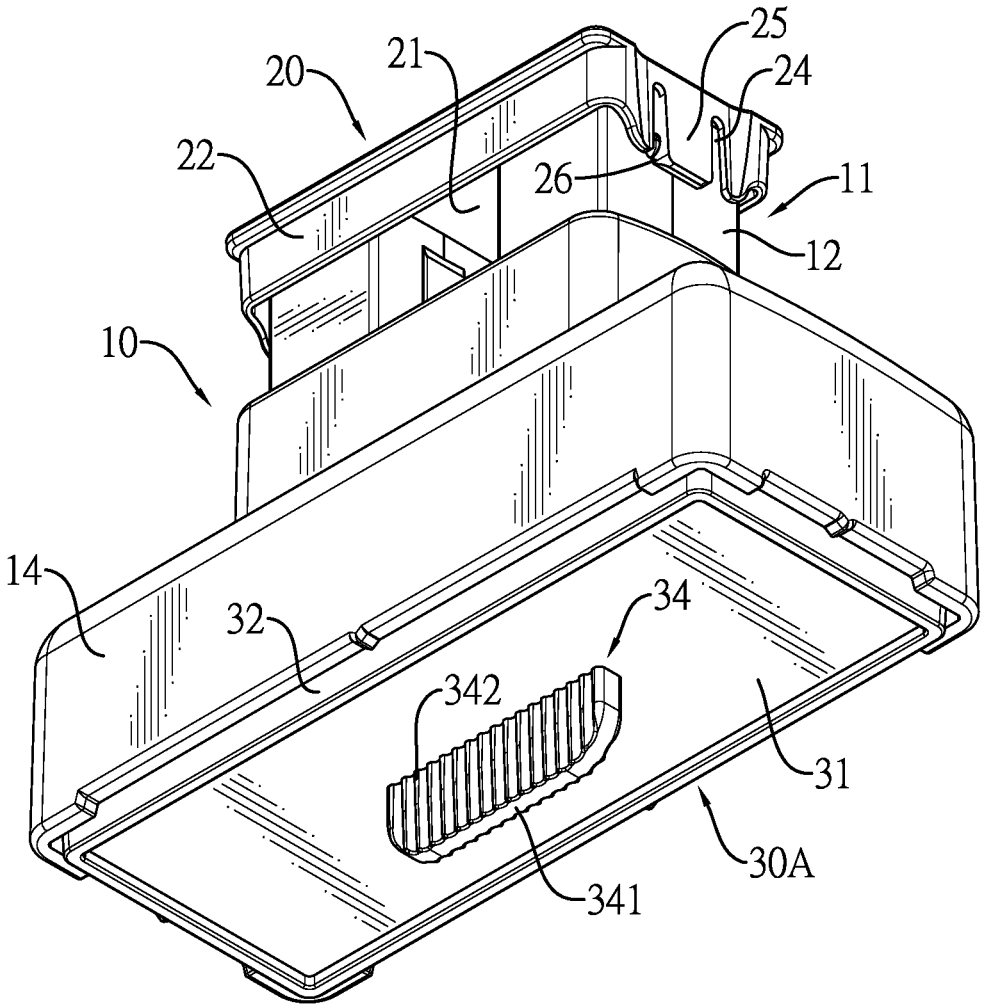
FIG. 1 is a perspective view of a first embodiment of a covering assembly for a stamp in accordance with the present invention, showing the covering assembly is disposed on an inked printing assembly of the stamp.
Figure 2:
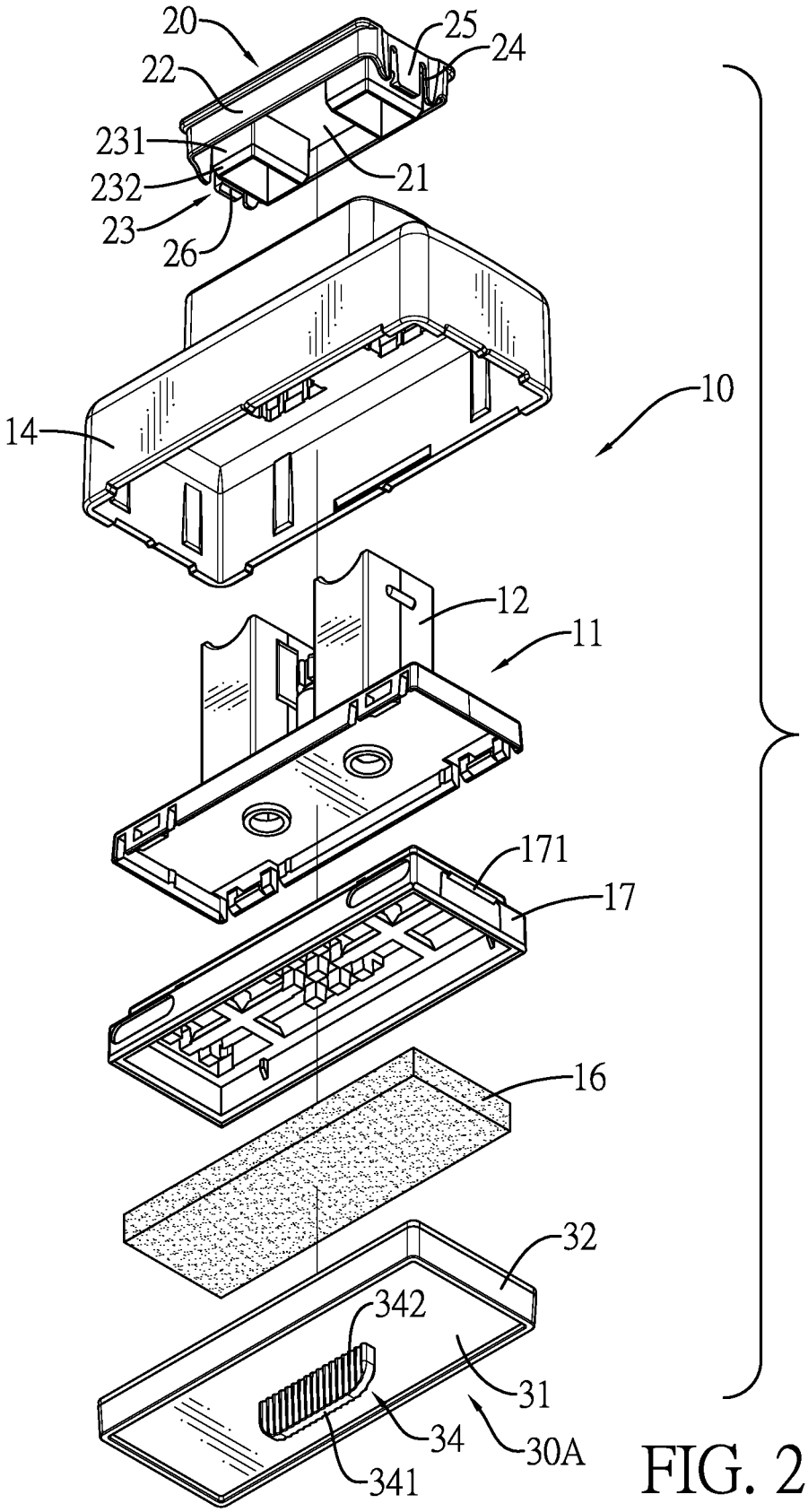
FIG. 2 is an exploded perspective view of the covering assembly in FIG. 1.
Figure 5:
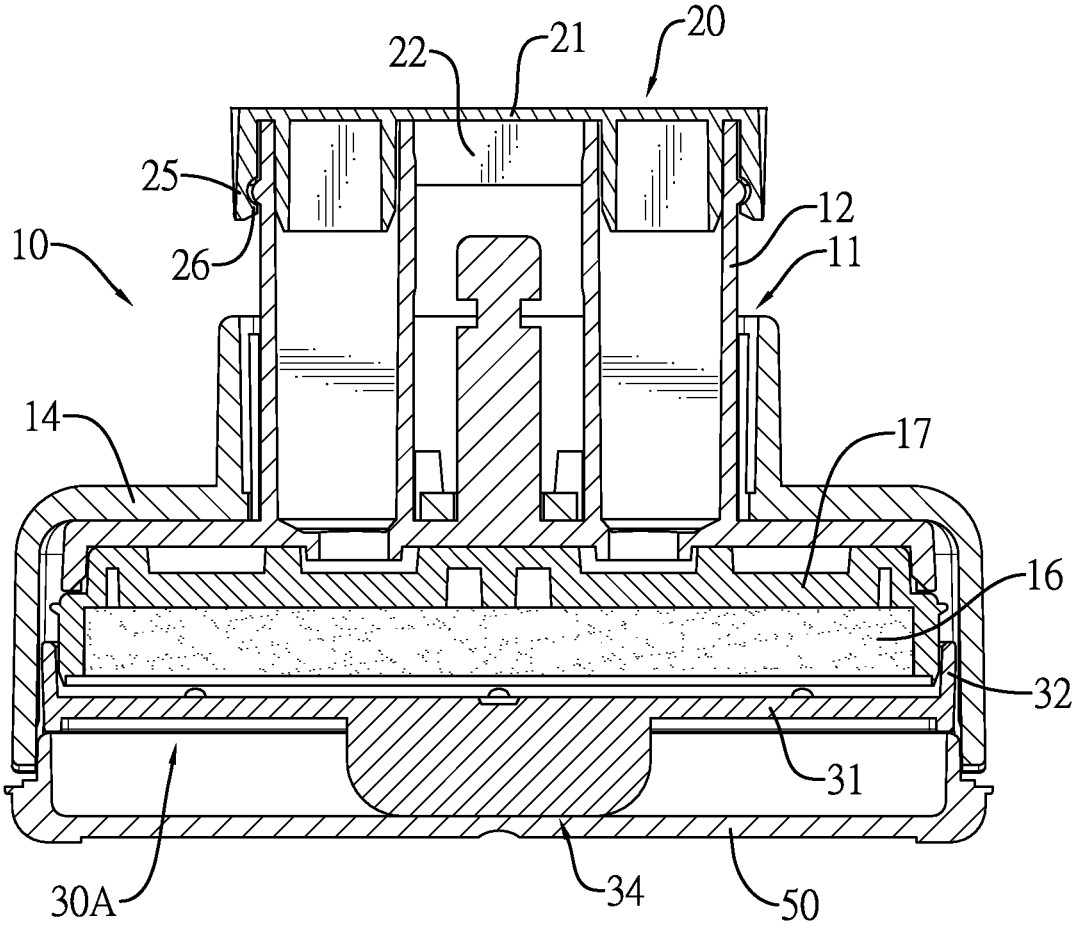
FIG. 5 is a cross sectional front side view of the covering assembly in FIG. 1, showing a protecting cover engages with a fixing seat of the stamp.
Figure 6:
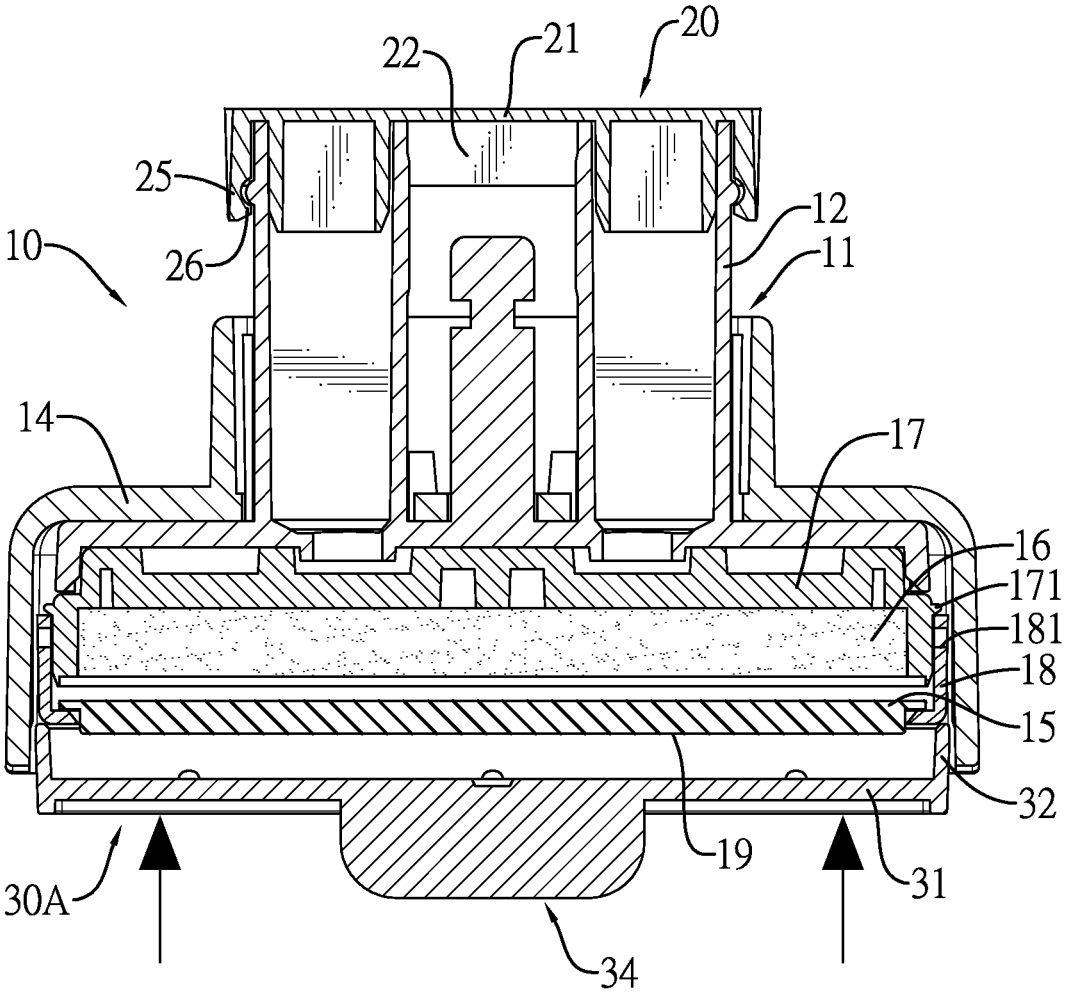
FIG. 6 is an operational and cross sectional front side view of the covering assembly in FIG. 1, showing the bottom cover is forced for assembling the bottom frame on a top frame.
Figure 7:
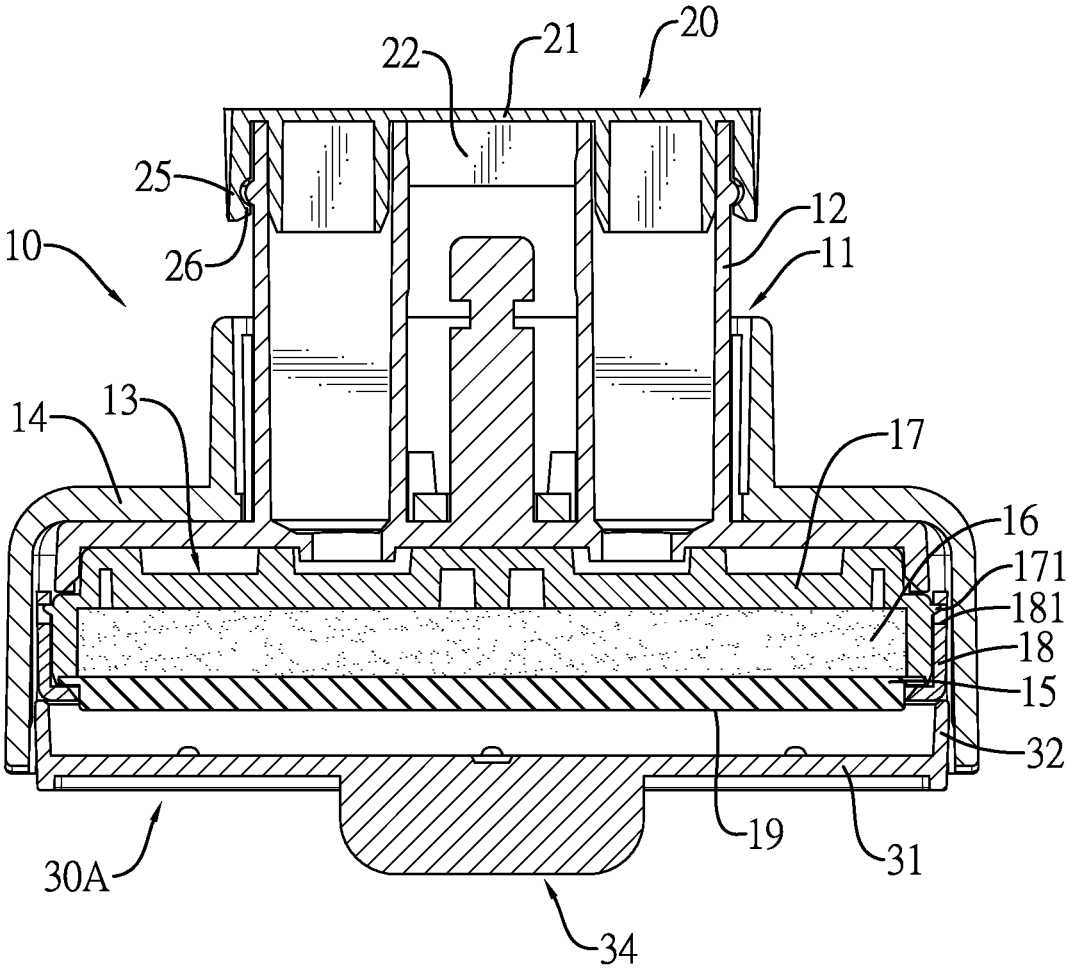
FIG. 7 is another operational and cross sectional front side view of the covering assembly in FIG. 1, showing the bottom frame engages with a top frame.

With reference to FIGS. 1 and 2, in delivery, assembly of an inked printing assembly 10 is not finished yet. A covering assembly for a stamp in accordance with the present invention is disposed on the inked printing assembly 10 and is not assembled completely. With reference to FIGS. 5 to 7, the covering assembly is applied to assist a moving seat 11 of the inked printing assembly 10 for assembly. The covering assembly is disposed on the moving seat 11 of the stamp for assisting a bottom frame 18 of a printing member 13 of the moving seat 11 to engage with a top frame 17 of the printing member 13 of the moving seat 11. The covering assembly has a top cover 20 and a bottom cover 30A.

With reference to FIGS. 1 and 2, the top cover 20 is detachably disposed above the inked printing assembly 10. The top cover 20 has a covering plate 21 and a top wall 22. The covering plate 21 has an outer edge. The top wall 22 is formed on and downwardly protrudes out of the outer edge of the covering plate 21. In addition, the covering plate 21 has a bottom surface. The top cover 20 has a retaining member 23. The retaining member 23 is formed on and downwardly extends out of the bottom surface of the covering plate 21. The retaining member 23 has at least one retaining wall 231 and at least one guiding surface 232. The at least one retaining wall 231 is formed on and downwardly extends out of the bottom surface of the covering plate 21. The at least one guiding surface 232 is formed on a bottom of a corresponding one of the at least one retaining wall 231.

In addition, the top wall 22 has a bottom edge, two side surfaces, four slots 24, and two positioning arms 25. The two side surfaces of the top wall 22 are opposite to each other. Each two of the slots 24 are formed on one of the two side surfaces of the top wall 22 at a spaced interval and downwardly extend to the bottom edge of the top wall 22. Each one of the two positioning arms 25 is formed on a corresponding one of the two side surfaces of the top wall 22, is located between the two slots 24 on the corresponding one of the two side surfaces of the top wall 22, and has an inner surface and a fixing protrusion 26 formed on the inner surface. Furthermore, the covering plate 21 is rectangular.

Figure 3:
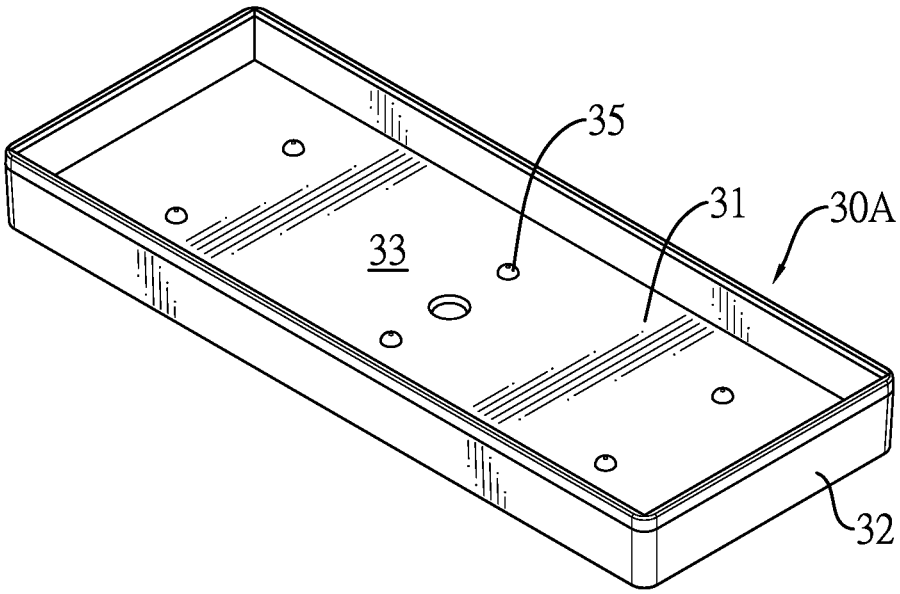
FIG. 3 is an enlarged perspective view of a bottom cover of the covering assembly in FIG. 1.

With reference to FIGS. 2 and 3, the bottom cover 30A is detachably disposed below the inked printing assembly and is located below the top cover 20 at a spaced interval. The bottom cover 30A has a supporting plate 31, a bottom wall 32, and a chamber 33. The supporting plate 31 has an outer edge. The bottom wall 32 is formed on and upwardly protrudes out of an outer edge of the supporting plate 31. The chamber 33 is formed in the bottom cover 30A and is enclosed by the bottom wall 32. The supporting plate 31 of the bottom cover 30A has a bottom surface. The bottom cover 30A has a grabbing member 34. The grabbing member 34 is disposed on and protrudes out of the bottom surface of the supporting plate 31.

Figure 10:
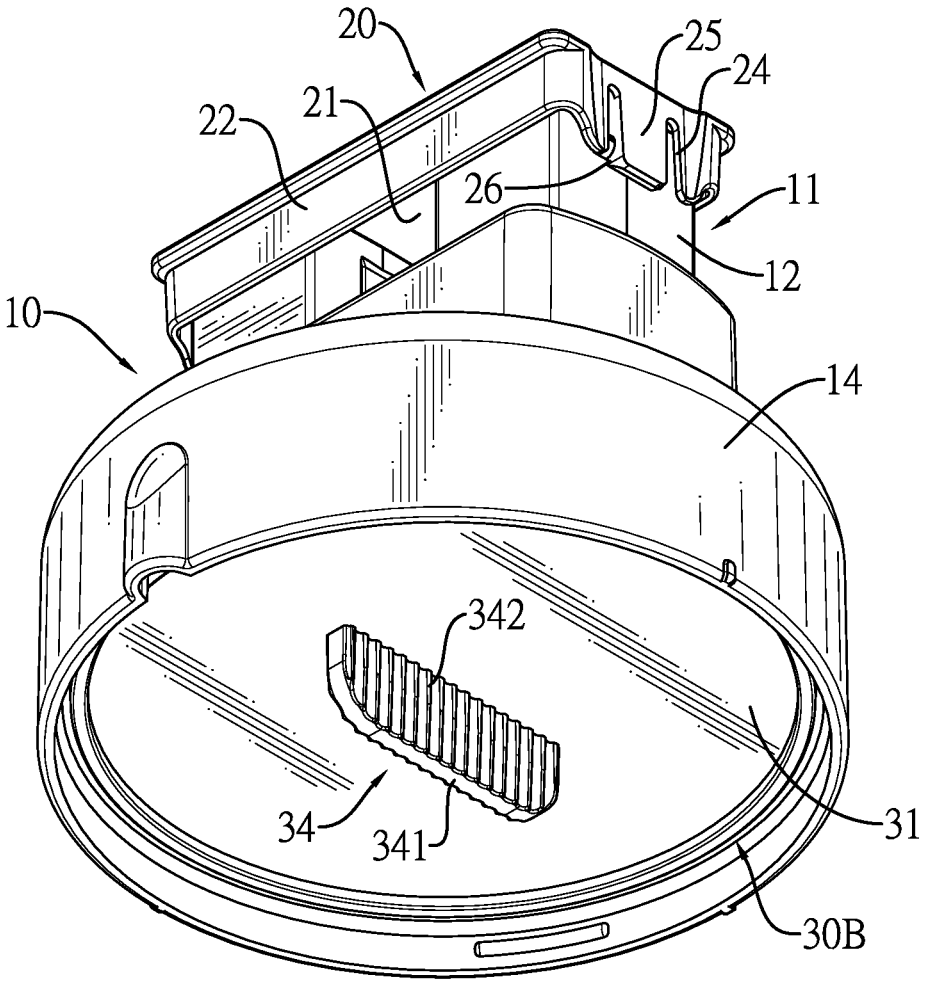
FIG. 10 is a perspective view of a second embodiment of a covering assembly for a stamp in accordance with the present invention, showing the covering assembly is disposed on an inked printing assembly of the stamp.

The grabbing member 34 has a wing 341 and two slip-proof portions 342. The wing 341 is disposed on the bottom surface of the supporting plate 31, extends downwardly, and has two side surfaces. The two slip-proof portions 342 are respectively formed on the two side surfaces of the wing 341. The supporting plate 31 has a top surface opposite to the bottom surface of the supporting plate 31. The bottom cover 30A has at least one protruding element 35. The at least one protruding element 35 is formed on and protrudes out of the top surface of the supporting plate 31 and is inserted into the chamber 33 of the bottom cover 30A. With reference to FIG. 1, the supporting plate 31 of the bottom cover 30A is rectangular. With reference to FIG. 10, the supporting plate 31 of the bottom cover 30B is circular.

With reference to FIGS. 2 and 5, in delivery, the inked printing assembly 10 is not assembled completely. An inked member 12 is disposed in a fixing seat 14 of the inked printing assembly 10. The top cover 20 is disposed on a top end of the inked member 12. The retaining member 23 is inserted into the inked member 12. The covering plate 21 of the top cover 20 abuts against the top end of the inked member 12. The top wall 22 of the top cover 20 is disposed around the top end of the inked member 12. The positioning arms 25 of the top cover 20 engage with the inked member 12 by the fixing protrusions 26. The top frame 17 of the printing member 13 engages with the inked member 12. An ink pad 16 of the printing member 13 is disposed on the top frame 17. The bottom cover 30A is inserted into the fixing seat 14 and is located below the top frame 17 and the ink pad 16. A protecting cover 50 of the stamp is disposed on the fixing seat 14 and is located below the bottom cover 30A.

Figure 4:
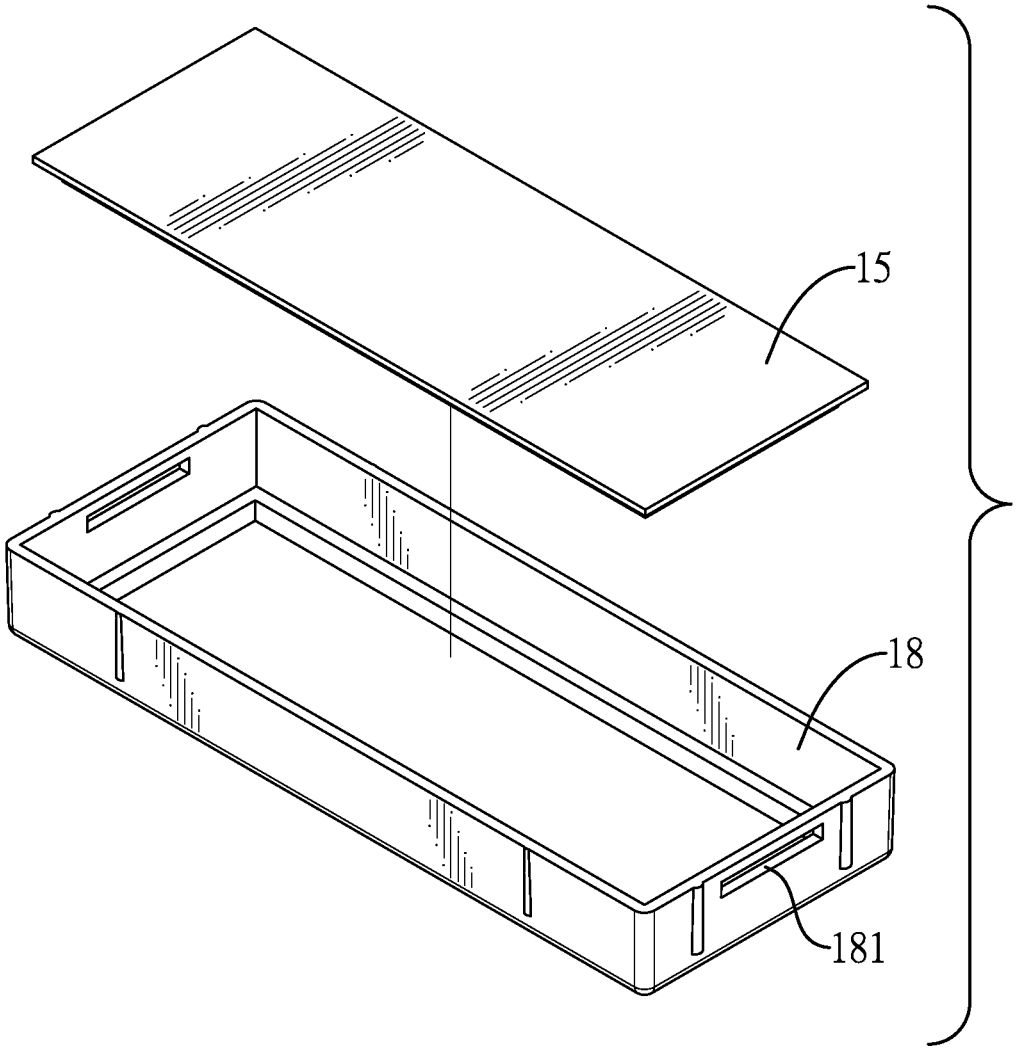
FIG. 4 is an enlarged and exploded perspective view of a block and a bottom frame in the inked printing assembly.

When a user receives the inked printing assembly 10 not yet assembled completely, the bottom cover 30A can be detached by the wing 341 for preparing the subsequent assembly operation. With reference to FIG. 4, a block 15 of the printing member 13 is exposed and etched, and then the block 15 is disposed on a bottom frame 18.

Figure 8:
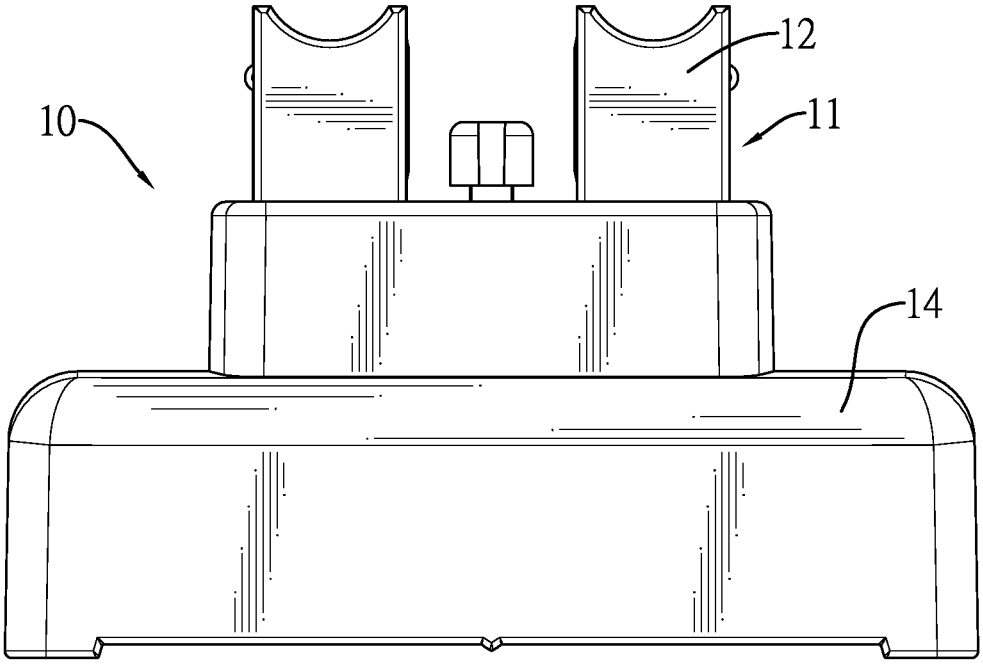
FIG. 8 is a front side view of the inked printing assembly in FIG. 7, showing the covering assembly is detached.
Figure 9:
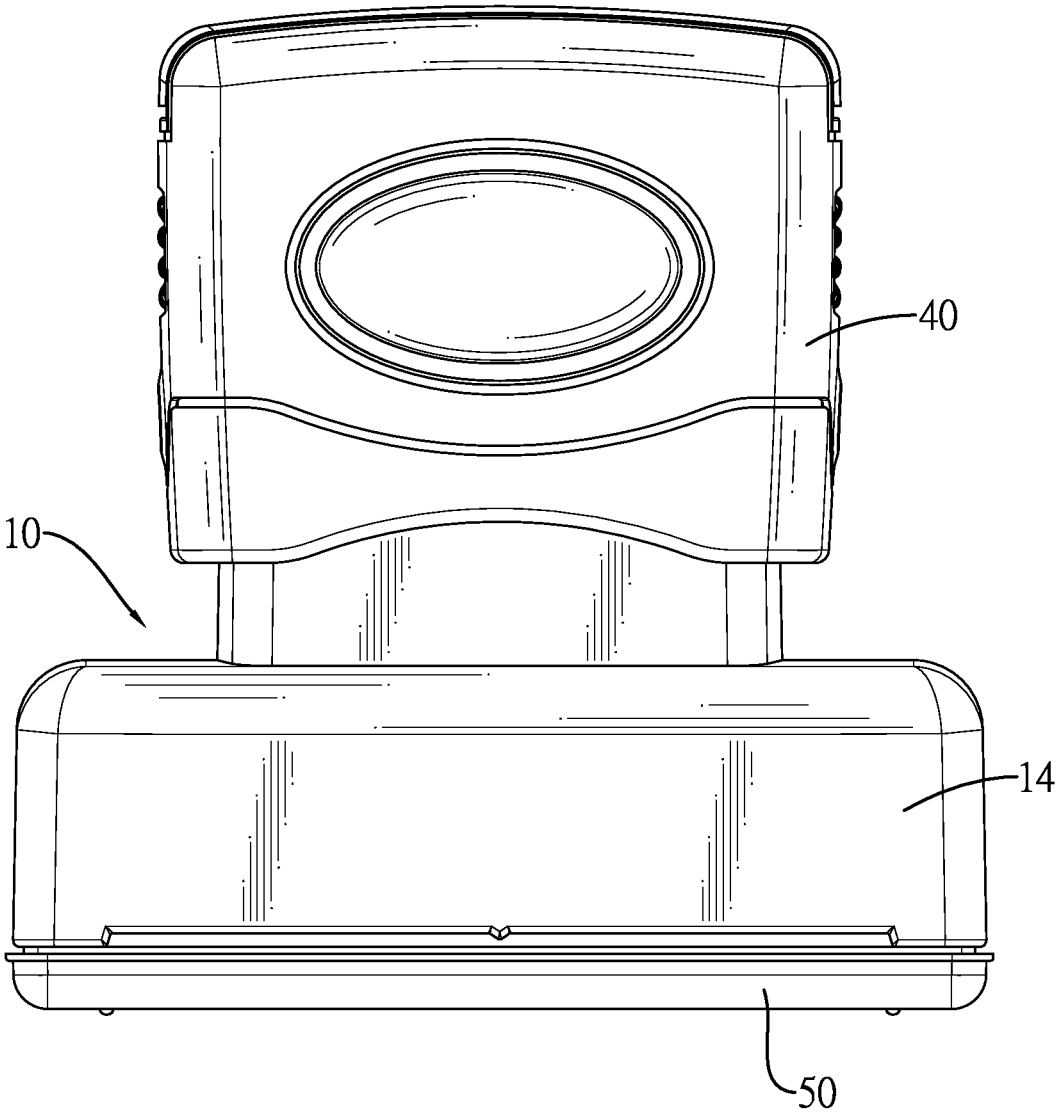
FIG. 9 is a front side view of the stamp in FIG. 8, showing a handle and a protecting cover are disposed on the inked printing assembly.

With reference to FIGS. 6 and 7, the block 15 and the bottom frame 18 engage with the top frame 17 by the bottom cover 30A. The block 15 of the printing member 13 is deposited on the bottom frame 18 of the printing member 13 and is inserted into the fixing seat 14. The bottom cover 30A is inserted into the fixing seat 14 and abuts against the bottom frame 18 of the printing member 13. A top edge of the bottom wall 32 of the bottom cover 30A abuts against an outer edge of a bottom surface of the bottom frame 18. The two hands of the user grab against two sides of the top cover 20 and two sides of the bottom cover 30A for applying force. Each of the two hands abuts the top cover 20 and the bottom cover 30A. The bottom frame 18 is pushed by the bottom cover 30A. The engaging protrusions 171 of the top frame 17 are respectively inserted into the engaging recesses 181 of the bottom frame 18. The bottom frame 18 is uniformly forced for engaging with the top frame 17. With reference to FIGS. 7 to 9, the top cover 20 and the bottom cover 30A disposed on the inked printing assembly 10 that is completely assembled can be detached. A handle 40, a restoring member, and the protecting cover 50 are assembled on the inked printing assembly 10 to finish the assembly of the stamp.

Accordingly, the covering assembly can assist with assembling the top frame 17 and the bottom frame 18. The covering plate 21 of the top cover 20 and the bottom wall 32 of the bottom cover 30A, 30B can transfer the pointed force into the planar force for increasing a contact area. The bottom frame 18 can be uniformly forced for engaging with the top frame 17 smoothly. The forcing uniformity and the assembly convenience are increased.

In addition, the covering assembly can be disposed on the inked printing assembly 10 not yet assembled completely. The top cover 20 and the bottom cover 30A, 30B can protect ink in the ink pad from evaporating during delivery. Furthermore, the grabbing member 34 of the bottom cover 30A can be easily grabbed by the user for detaching the bottom cover 30A from the fixing seat 14. Grabbing stability is increased by the slip-proof portions 342 of the grabbing member 34.

What is claimed is:

1. A covering assembly for a stamp comprising:

an inked printing assembly, having a top frame and a bottom frame;

a top cover detachably disposed above the inked printing assembly, and having a covering plate having an outer edge; and a top wall formed on and downwardly protruding out of the outer edge of the covering plate;

a bottom cover detachably disposed below the inked printing assembly, located below the top cover at a spaced interval, and having a supporting plate having an outer edge and a bottom surface;

a grabbing member disposed on and protruding out of the bottom surface of the supporting plate, and having a wing disposed on the bottom surface of the supporting plate, extending downwardly, and having two side surfaces; and two slip-proof portions respectively formed on the two side surfaces of the wing;

a bottom wall formed on and upwardly protruding out of the outer edge of the supporting plate; and a chamber formed in the bottom cover and enclosed by the bottom wall;

wherein a top edge of the bottom wall of the bottom cover abuts against an outer edge of a bottom surface of the bottom frame.

2. The covering assembly as claimed in claim 1, wherein the supporting plate has a top surface opposite to the bottom surface of the supporting plate, the bottom cover has at least one protruding element, and the at least one protruding element is formed on and protrudes out of the top surface of the supporting plate and is inserted into the chamber of the bottom cover.

3. The covering assembly as claimed in claim 2, wherein the covering plate has a bottom surface, the top cover has a retaining member, and the retaining member is formed on the bottom surface of the covering plate and extends downwardly.

4. The covering assembly as claimed in claim 2, wherein the top wall has a bottom edge, two side surfaces, four slots, and two positioning arms, the two side surfaces of the top wall are opposite to each other, each two of the slots are formed on one of the two side surfaces of the top wall at a spaced interval and downwardly extend to the bottom edge of the top wall, and each one of the two positioning arms is formed on a corresponding one of the two side surfaces of the top wall, is located between the two slots on the corresponding one of the two side surfaces of the top wall, and has an inner surface and a fixing protrusion formed on the inner surface.

5. The covering assembly as claimed in claim 1, wherein the covering plate has a bottom surface, the top cover has a retaining member, and the retaining member is formed on the bottom surface of the covering plate and extends downwardly.

6. The covering assembly as claimed in claim 1, wherein the top wall has a bottom edge, two side surfaces, four slots, and two positioning arms, the two side surfaces of the top wall are opposite to each other, each two of the slots are formed on one of the two side surfaces of the top wall at a spaced interval and downwardly extend to the bottom edge of the top wall, and each one of the two positioning arms is formed on a corresponding one of the two side surfaces of the top wall, is located between the two slots on the corresponding one of the two side surfaces of the top wall, and has an inner surface and a fixing protrusion formed on the inner surface.

* * * * *